US008888536B2

(12) United States Patent
Degner

(10) Patent No.: US 8,888,536 B2
(45) Date of Patent: Nov. 18, 2014

(54) LOW PROFILE HARD-DISK DRIVE CONNECTOR

(75) Inventor: Brett Degner, Menlo Park, CA (US)

(73) Assignee: Apple Inc., Cupertino, CA (US)

( * ) Notice: Subject to any disclaimer, the term of this patent is extended or adjusted under 35 U.S.C. 154(b) by 79 days.

(21) Appl. No.: 13/492,898

(22) Filed: Jun. 10, 2012

(65) Prior Publication Data

US 2013/0330977 A1 Dec. 12, 2013

(51) Int. Cl.
*H01R 24/00* (2011.01)

(52) U.S. Cl.
USPC ..... 439/660; 439/295

(58) Field of Classification Search
USPC ..... 439/74, 79, 295, 660
See application file for complete search history.

(56) References Cited

U.S. PATENT DOCUMENTS 3,193,793 A * 7/1965 Plunkett et al. ..... 439/660
4,734,060 A * 3/1988 Kawawada et al. ..... 439/660
4,971,565 A * 11/1990 Fox, Jr. ..... 439/74
5,127,839 A * 7/1992 Korsunsky et al. ..... 439/79
5,181,855 A * 1/1993 Mosquera et al. ..... 439/74
5,501,612 A * 3/1996 Green ..... 439/499
5,520,545 A * 5/1996 Sipe ..... 439/65
5,593,311 A * 1/1997 Lybrand ..... 439/295
7,104,807 B1 * 9/2006 Wang et al. ..... 439/76.1
7,980,898 B2 * 7/2011 Chatterjee ..... 439/660
8,517,773 B2 * 8/2013 Lee et al. ..... 439/660

* cited by examiner

*Primary Examiner* — Thanh Tam Le
(74) *Attorney, Agent, or Firm* — Kilpatrick Townsend & Stockton LLP

(57) ABSTRACT

Connector receptacles for hard-disk drives that do not consume a significant amount of space. One connector receptacle may include a housing having one or more horizontal slots corresponding to one or more tongues of a connector insert. The connector receptacle may include a number of vertical slots, each having a contact to form an electrical connection with a contact on the one or more tongues. These contacts may emerge from the top of the housing to connect to a flexible conductor. A stiffening layer may be placed over the top of the flexible conductor. The housing may also include vertical bridging pieces that may be located between a top portion and a bottom portion of the connector receptacle. Shielding may be included above, in front of, or below the housing, or any combination thereof.

28 Claims, 9 Drawing Sheets

LOW PROFILE HARD-DISK DRIVE CONNECTOR

BACKGROUND

The number and types of electronic devices available to consumers have increased tremendously the past few years, and this increase shows no signs of abating. Devices such as portable computers, laptops, netbooks, tablets, desktops, all-in-one computers, storage devices, portable media players, televisions and other display devices, navigation systems, monitors and other devices have become ubiquitous.

The sizes of these devices have been shrinking over the last few years. For example, many of these devices have been getting thinner. The thickness of electronic devices such as tablet and laptop computers has become an important marketing concern as well as a highly visible feature to consumers.

While these devices have been getting thinner, their functionality has been increasing. For example, larger memories, WiFi and cellular interface capabilities, larger batteries for longer battery life, and others, have become common features of these devices.

These electronic devices may include various electronic components such as hard-disk drives, solid-state drives, optical drives, batteries, keyboards, trackpads, display screens, and other components. These components often need to be connected to a main-logic board or other substrate. These connections may include a connector to make electrical connections to contacts connected to the electronic component.

Often these connectors may be fairly large. Also, what was a reasonable size for one generation of a device may become quite unreasonable for a smaller, next generation device. For example, a hard-disk drive may include a male connector or connector insert having one or more tongues supporting contacts for the hard-disk drive. A female connector or connector receptacle that fits over these tongues may increase the effective size of the hard-disk drive. This increase in size may either force an increase in the size of the electronic device, or a decrease in the functionality that may be included in the electronic device.

Thus, what is needed are connector receptacles for hard-disk drives and other devices that do not consume a significant amount of space.

SUMMARY

Accordingly, embodiments of the present invention may provide female connectors or connector receptacles for hard-disk drives and other devices that do not consume a significant amount of space. An illustrative embodiment of the present invention may provide a connector receptacle that does not extend significantly beyond a leading edge of a connector tongue of a male connector or connector insert of a hard-disk drive or other device. This connector receptacle may also not extend significantly above, below, or to the sides of the enclosure for a hard-disk drive or other device. That is, the connector receptacle may not add significantly to the length, width, or height of the hard-disk drive or other device.

An illustrative embodiment of the present invention may provide a connector receptacle having a housing, where the housing may have one or more horizontal openings to accept one or more tongues of a connector insert extending from a hard-disk drive enclosure. The housing may be arranged to not extend significantly beyond the leading edges of the one or more tongues of the connector insert, above or below the enclosure of the hard-disk drive, or beyond the sides of the connector insert. The housing of the receptacle may further include a number of vertical slots. Contacts may be located in each slot, each contact having a first portion to electrically connect to a contact on a tongue and a second portion extending above a top of the housing. The housing may be covered by a flexible conductor. The flexible conductor may include a number of individual conductors or wires to carry power or signals. For example, it may be a flexible substrate having or supporting a number of conductors. The various individual conductors may be electrically connected to the contacts of the connector receptacle. The flexible conductor may also be a flexible circuit board, ribbon cable, or other appropriate flexible conductor.

A stiffening layer or flex stiffener may be placed over the flexible conductor along a top of the connector receptacle. This layer may stabilize the flexible conductor, thus providing a suitable substrate for contacts to be soldered to.

During assembly, the contacts of the receptacle may be preloaded or biased before they are inserted into the housing in order to improve the electrical connection with contacts on the tongues of the connector insert. Specifically, the contacts may include a third portion extending towards a back of the housing. The third portion may include protrusions on each side. Near the back of the housing, each vertical slot may narrow and may include a horizontal lip or step. A preloaded contact may be inserted such that the third portion of the contact is held in place by the horizontal lip or step, and the protrusions may dig into the narrowing portion of the slot such that the contact cannot easily retract out of the slot and is instead held securely in place.

This preloading may create an upward force on the top of the connector receptacle housing. This upward force may create a bowing. Such bowing may lead to a decrease in force between contacts near a middle of the connector receptacle. A variance in contact forces may degrade connector performance and reliability.

This tendency to bow that is created by the preloading of the contacts may also push a top portion of the connector receptacle above the one or more tongues away from a bottom portion of the connector receptacle below the one or more tongues of the insert. Accordingly, vertical bracing or bridging portions may be included between the top portion of the connector receptacle and the bottom portion of the connector receptacle. These may be located between and to the sides of the one or more horizontal openings in the connector receptacle for the one or more tongues on the connector insert.

Various embodiments of the present invention may include shielding around at least a portion of the connector receptacle to improve high-speed performance. For example, the stiffening layer may be made of metal and grounded to provide a shield layer over the flexible conductor. Shielding may instead be placed over the top of the stiffening layer, the front of the housing, the underside of the housing of the connector receptacle, or any combination of these locations.

The flexible conductor may exit away from the connector in various ways. For example, it may exit away over the top of the hard-disk drive. It may also take advantage of the lack of space consuming features on the connector receptacle, such as the absence of so called "lead-in pins." The absence of these pins leaves a space on the sides of the connector receptacle, and this space may be repurposed and used as an exit path for the flexible conductor, shown here as flexible conductor portion 532.

Various portions of these connector receptacles may be formed of various materials. For example, the housing may be formed of plastic, nylon, liquid-crystal polymers (LCPs), or other nonconductive materials. The contacts may be formed of copper, copper titanium, phosphor bronze, or other material. They may be plated or coated with nickel, gold, or other material. The flexible conductor may be a flexible circuit board or other circuit board, such as one made using FR4, ribbon cable, or other type of conductor. Again, it may be a flexible substrate supporting a number of conductors. The stiffening layer may be metal, FR4, polyimide, polyamide, or made of other material or materials.

While various embodiments of the present are well-suited as connector receptacles for hard-disk drives, such as 2.5 or 3.5 inch Serial Advanced Technology Attachment (SATA) hard-disk drives, other embodiments of the present invention may be used as connectors for other devices, such as solid state drives, optical drives, batteries, keyboards, trackpads, display screens, and other components. These components may be employed in electronic devices such as portable computers, tablets, desktops, all-in-one computers, cell, smart, and media phones, storage devices, portable media players, navigation systems, monitors and other devices Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
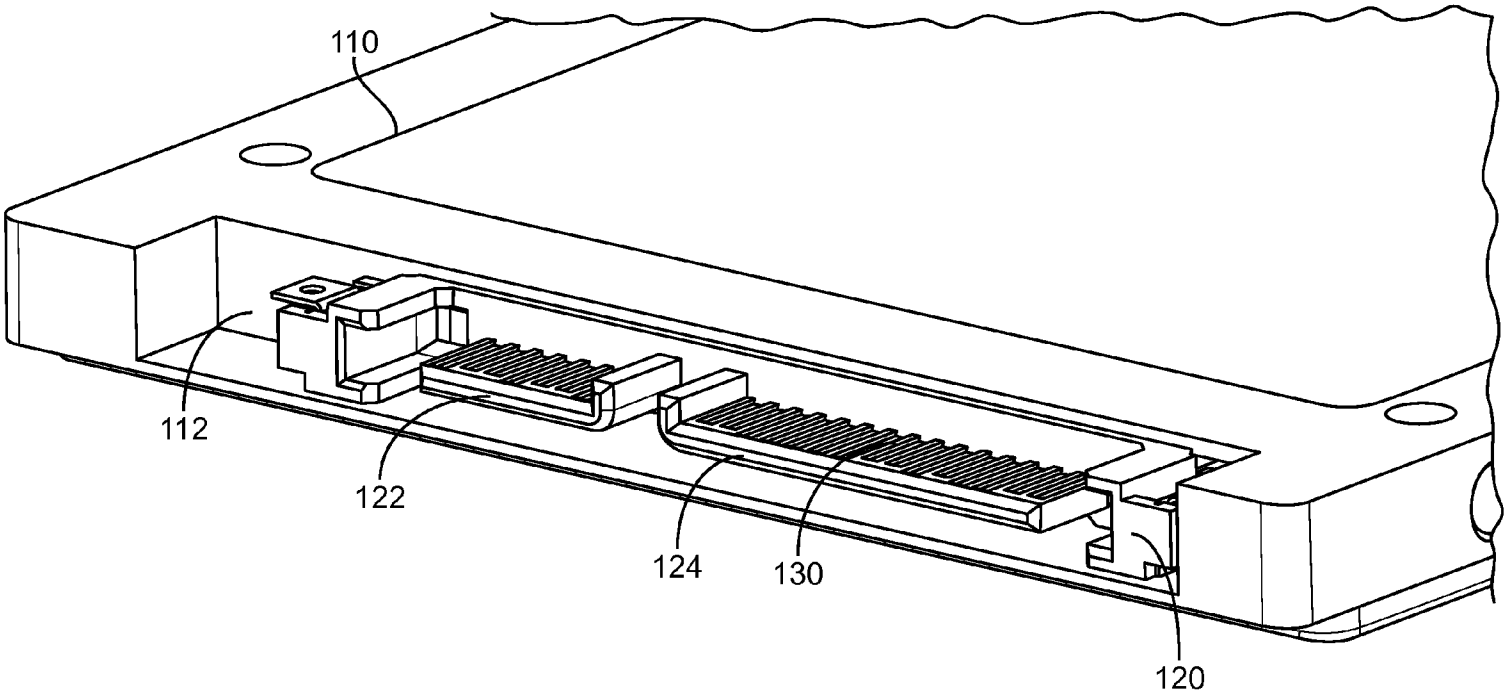
FIG. 1 illustrates a portion of a hard-disk drive that may connect to a main-logic board or other electronic component using a connector receptacle according to an embodiment of the present invention.

FIG. 1 illustrates a portion of a hard-disk drive that may connect to a main-logic board or other electronic component using a connector receptacle according to an embodiment of the present invention. Hard-disk drive 110 may include a recessed portion 112. Male connector or connector insert 120 may include one or more tongues, shown here as tongues 122 and 124. A number of contacts 130 may reside on tongues 122 and 124. In various embodiments of the present invention, hard-disk drive connector inserts 120 may include one, two, three, or more than three tongues. Contacts 130 may be plated areas on tongues 122 and 124, they may be metal contact pins, or they may be other types of contacts.

A connector receptacle according to an embodiment of the present invention may connect to hard-disk drive connector insert 120. This connector receptacle may include contacts for forming electrical connections with contacts 130. One or more conductors may connect to the contacts in the connector receptacle, where the conductor conveys power and signals between hard-disk drive 110 and a main-logic board or other electrical component.

Figure 2:
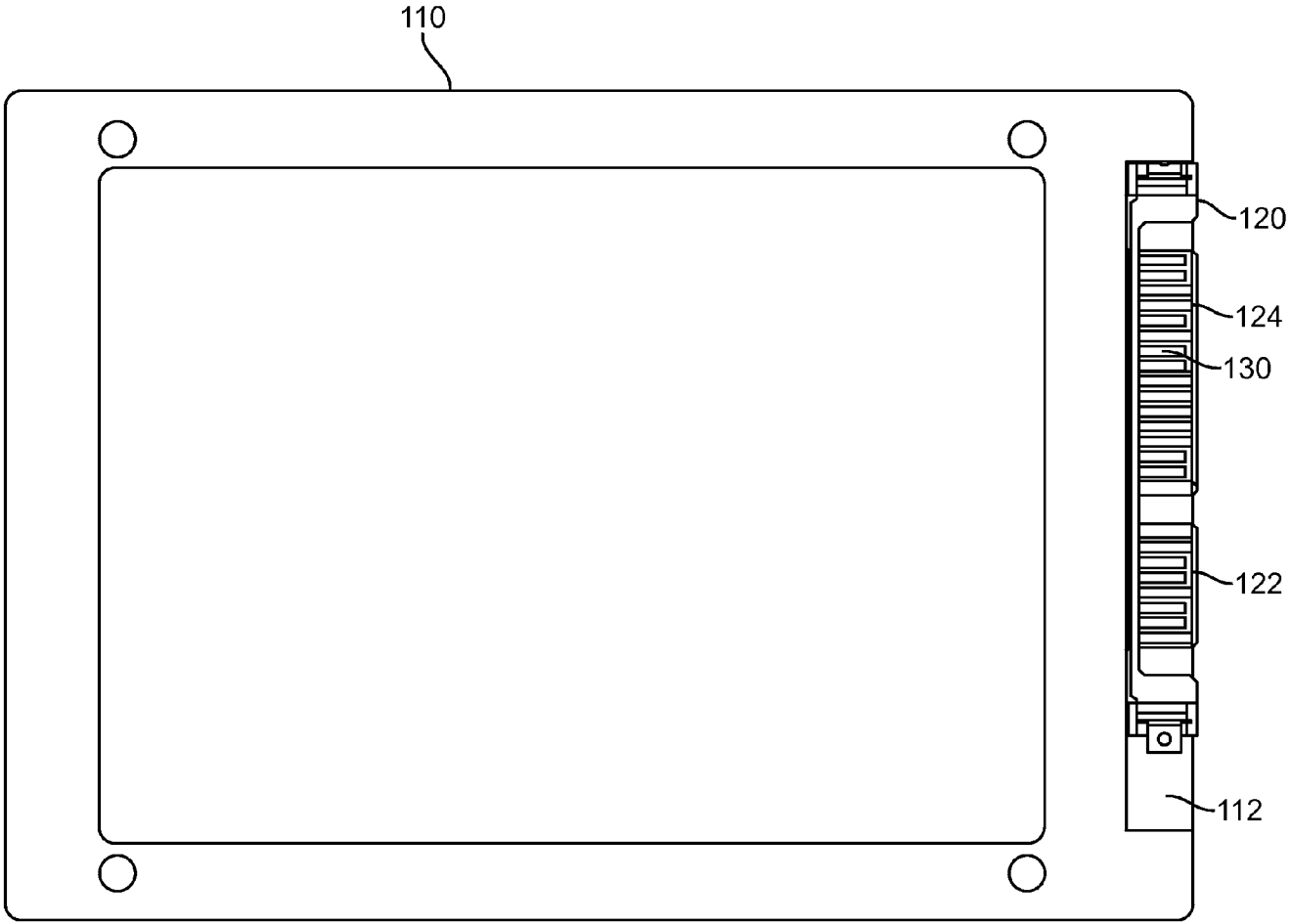
FIG. 2 illustrates a top view of a hard-disk drive that may connect to a main-logic board or other electronic component using a connector receptacle according to an embodiment of the present invention.

FIG. 2 illustrates a top view of a hard-disk drive that may connect to a main-logic board or other electronic component using a connector receptacle according to an embodiment of the present invention. Again, hard-disk drive 110 may include a recessed portion 112. A connector insert 120 having tongues 122 and 124 may reside in recess 112. Contacts 130 may be located on tongues 122 and 124 of connector insert 120.

While embodiments of the present invention are particularly well-suited to hard-disk drive connector receptacles, embodiments of the present invention may be used for connector receptacles for other types of components such as solid state drives, optical drives, batteries, keyboards, trackpads, display screens, and other components. These components may be located in electronic devices such as portable computers, laptops, netbooks, tablets, desktops, all-in-one computers, storage devices, portable media players, televisions and other display devices, navigation systems, monitors and other devices.

Again, signals and power may be transferred between a main-logic board or other electrical component and hard-disk drive 110 via contacts 130. Accordingly a connector receptacle may attach to connector insert 120 to form electrical connections with contacts 130. If this connector is large, the effective space consumed by hard-disk drive 110 may be increased. This, in turn, may lead to an increase in size of electronic device that includes hard-disk drive 110. Alternatively, this may lead to a decrease in the functionality of the electronic device that includes hard-disk drive 110.

Accordingly, embodiments of the present invention may provide connector receptacles that do not extend significantly beyond a leading edge of the tongues 122 and 124 of connector insert 120. Embodiments of the present invention may also provide connector receptacles that do not extend significantly above or below an enclosure for hard-disk drive 110. That is, they may not add considerably to the thickness of the hard-disk drive 110. Also, embodiments of the present invention may provide connector receptacles that do not extend significantly beyond the length of connector insert 120. That is, they may not add considerably to the width of the hard-disk drive 110. An example is shown in the following figure.

Figure 3:
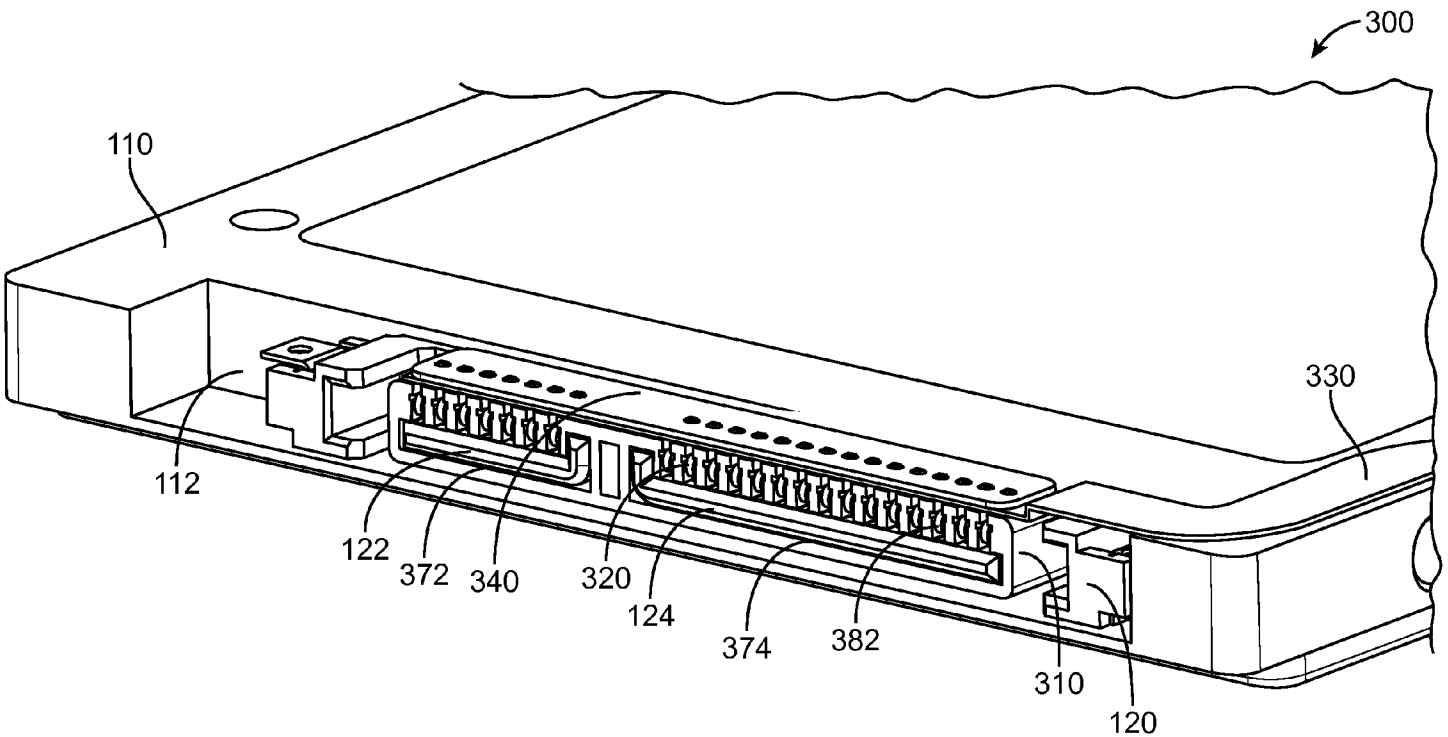
FIG. 3 illustrates a connector receptacle according to an embodiment of the present invention.

FIG. 3 illustrates a connector receptacle according to an embodiment of the present invention. Connector receptacle 300 may include housing 310 having horizontal openings 372 and 374 for tongues 122 and 124 of connector insert 120. In other embodiments of the present invention, housing 310 may include various numbers of openings for various numbers of tongues, such as one, three, or more than three tongues. Housing 310 may further include a number of vertical slots for 382 contacts 320. Contacts 320 may form electrical connections with contacts 130 on tongues 122 and 124 of connector insert 130. Contacts 320 may also form electrical connections with flexible conductor 330. Flexible conductor 330 may be a flexible circuit board, ribbon cable, or other appropriate conductor. Flexible conductor 330 may be a flexible substrate having or supporting a number of individual conductors, where the individual conductors may form electrical connections with contacts 320. In various embodiments of the present invention, more than one flexible conductor 330 may be used. For example, two flexible conductors 330 may be used, one for power and one for various signals. A stiffening layer 340 may be placed over a portion of flexible conductor 330. Stiffening layer 340 may stabilize flexible conductor 330, thus providing a suitable substrate for contacts 320 to be soldered to.

Figure 4:
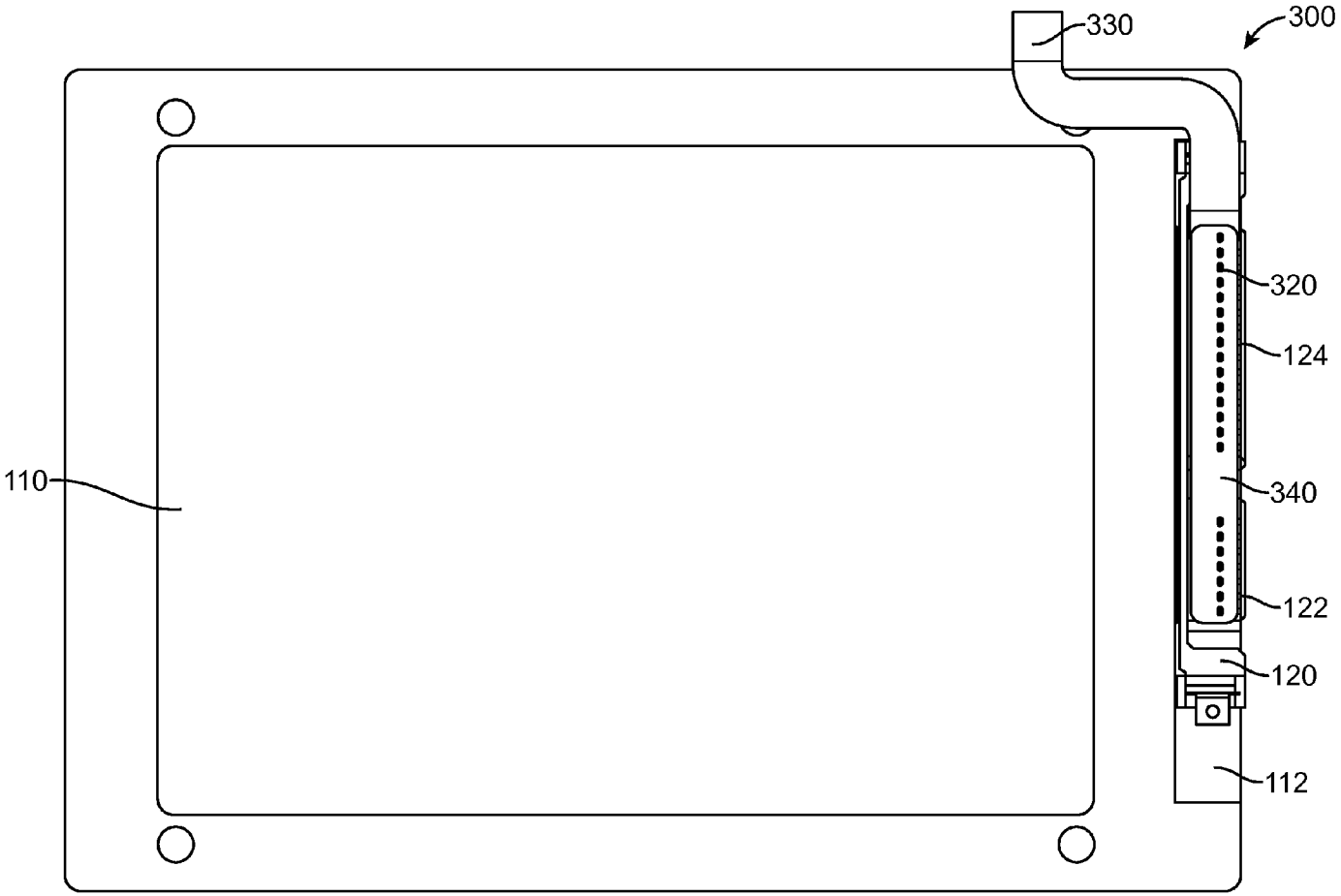
FIG. 4 illustrates a top view of a connector receptacle according to an embodiment of the present invention.

FIG. 4 illustrates a top view of a connector receptacle according to an embodiment of the present invention. Again, hard-disk drive 110 may include recess 112. Hard-disk drive connector insert 120 may reside in recess 112. Hard-disk drive connector insert 120 may include tongues 122 and 124. A connector receptacle according to an embodiment of the present invention, such as connector receptacle 300, may attach to hard-disk drive connector insert 120. Contacts of connector receptacle 300 may form electrical connections with conductors in flexible conductor 330. A stiffening layer 340 may be applied over a portion of flexible conductor 330. Openings in stiffening board 340 may form passages for portions of contacts 320.

Again, as can be seen, connector receptacle 300 does not extend significantly beyond leading edges of tongues 122 and 124 of connector insert 120. In this example, connector receptacle 300 also may not extend significantly above or below an enclosure for hard-disk drive 110. Connector receptacle 300 also may not extend significantly beyond the sides of connector insert 120. Accordingly, connector receptacle 300 may consume very little space inside of the electronic device that includes hard-disk drive 110.

Figure 5:
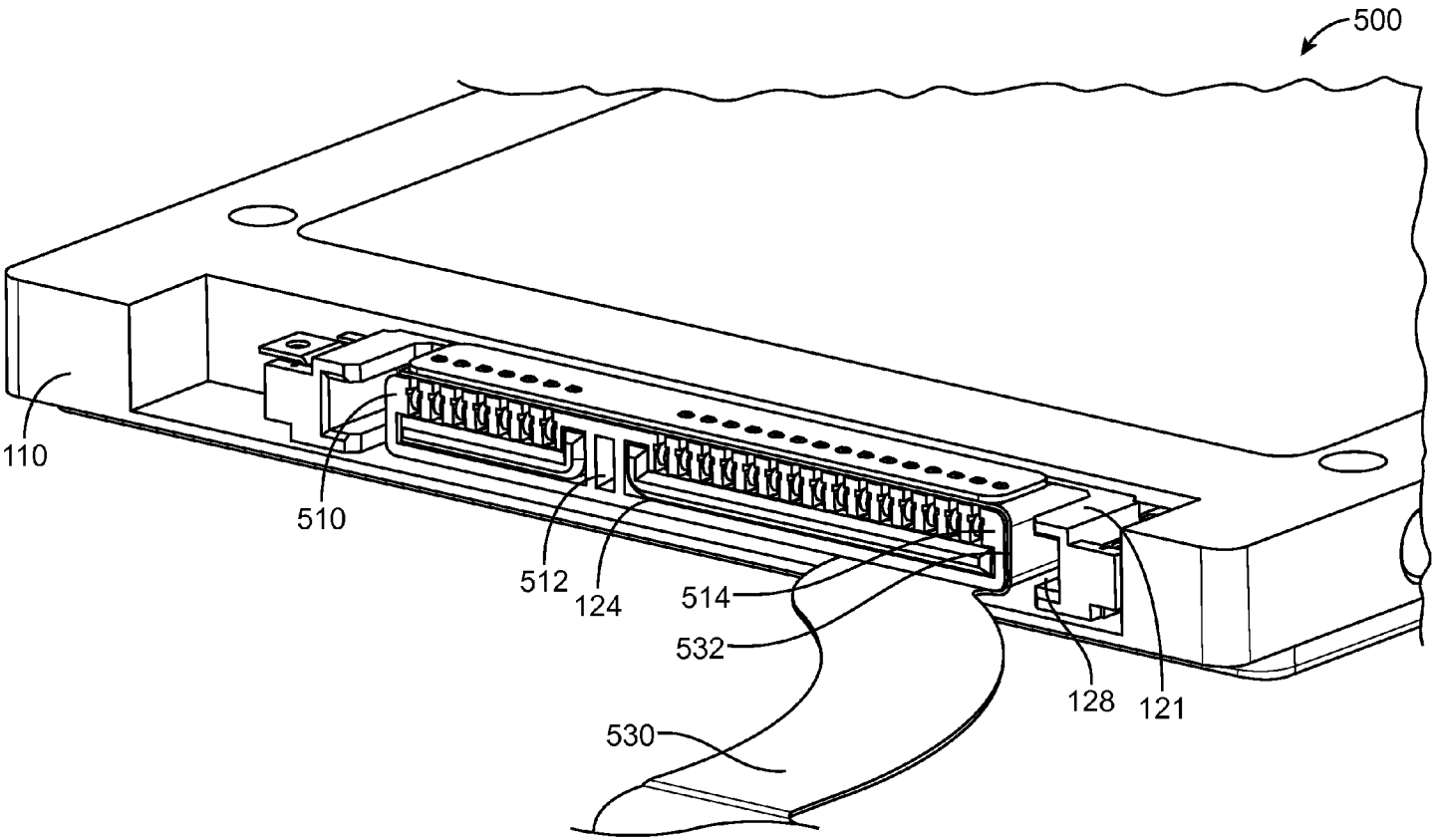
FIG. 5 illustrates another connector receptacle according to an embodiment of the present invention.

FIG. 5 illustrates another connector receptacle according to an embodiment of the present invention. In this example, a space 128 between tongue 124 and connector insert portion 121 is typically used to accept a leading edge pin of a connector receptacle. Since the illustrated connector receptacle 500 does not require a leading edge pin, this space may be repurposed for the routing of flexible conductor 530, which may be a flexible circuit board, ribbon cable, or other flexible conductor, such as a flexible substrate having or supporting a number of individual conductors.

Again, contacts 320 may cause a bowing or separation between a top portion of the connector receptacle above tongues 122 and 124 of connector insert 120 and a bottom portion of the connector receptacle below tongues 122 and 124. Accordingly, bridging pieces 510, 512, and 514 may be used to provide mechanical reinforcement.

Figure 6:
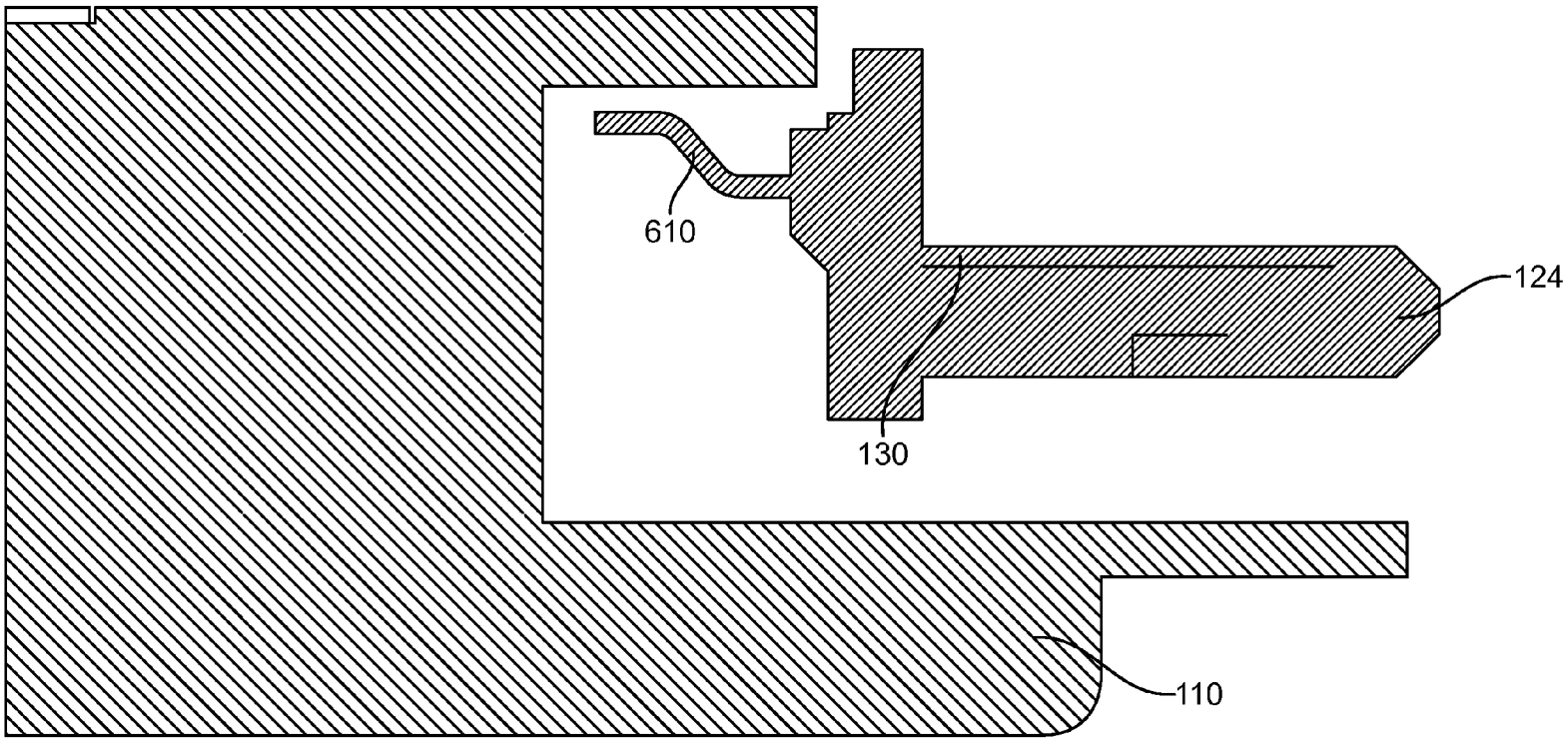
FIG. 6 illustrates a side view of a hard-disk drive that may be connected to using a connector receptacle according to an embodiment of the present invention.

FIG. 6 illustrates a side view of a hard-disk drive that may be connected to a main-logic board or other electrical component using a connector receptacle according to an embodiment of the present invention. Hard-disk drive 110 may include tongue 122 supporting a number of contacts 130. Passageways 610 may form an electrical connection between contacts 130 and circuitry inside hard-disk drive 110.

Figure 7:
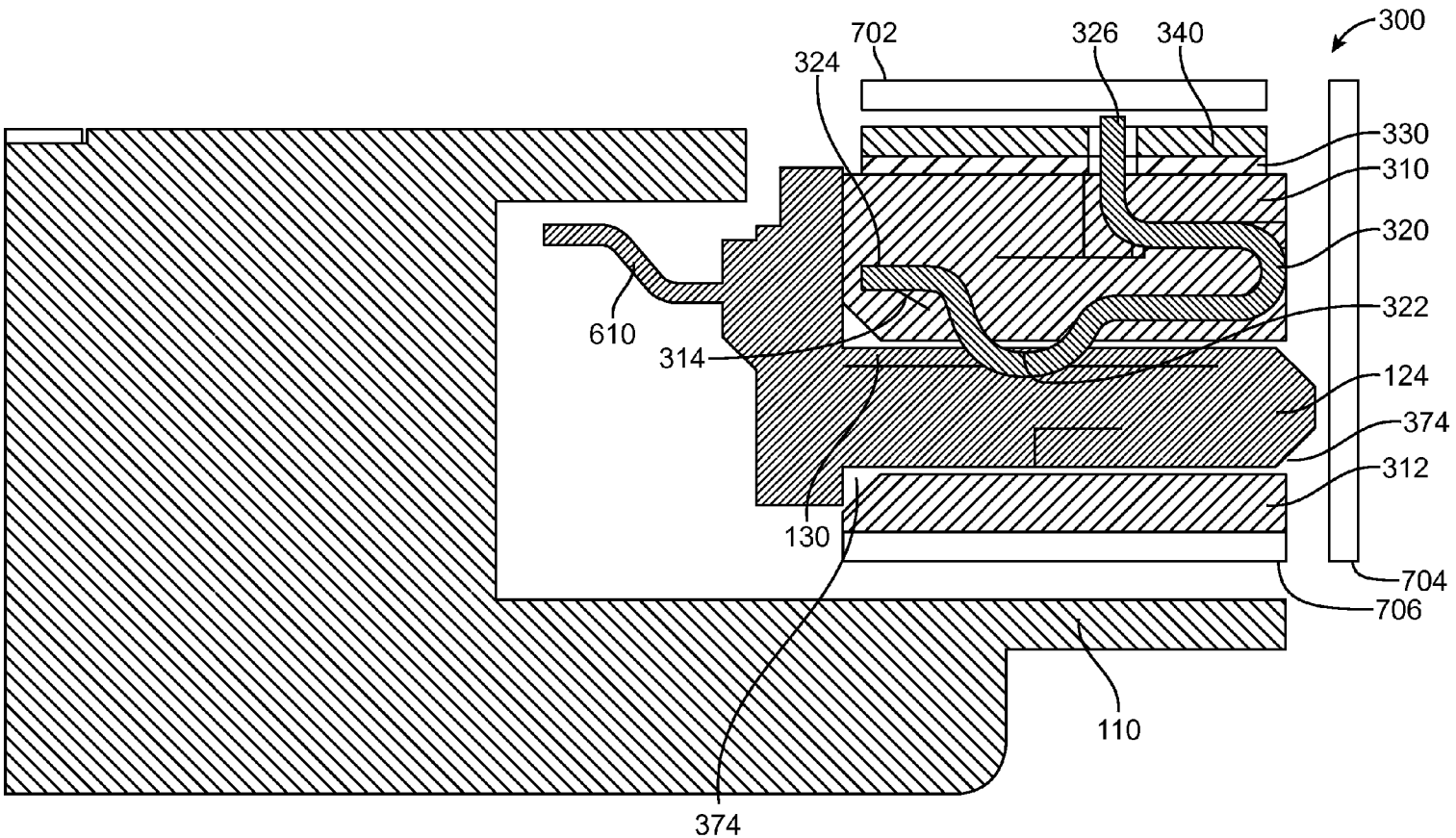
FIG. 7 illustrates a connector receptacle according to an embodiment of the present invention, the connector receptacle forming an electrical connection with connector insert on a hard-disk drive.

FIG. 7 illustrates a connector receptacle according to an embodiment of the present invention, the connector receptacle forming an electrical connection with connector insert on a hard-disk drive. Hard-disk drive 110 may include tongue 122 supporting a number of contacts 130. Passageways 610 may provide electrical connections between contacts 130 and circuitry inside hard-disk drive 110. A connector receptacle 300 according to an embodiment of the present invention may include housing 310 having a bottom portion 312. A number of contacts 320 may reside in housing 310. Contacts 320 may include a first portion 322 for contacting contacts 130 on connector insert 120 tongues 122 and 124, and a second portion 326 extending above housing 310. Contacts 320 may further include a third portion 324. Third portion 324 may be lodged in housing 310 to provide mechanical security for contact 320. Flexible conductor 330 may be located on top of housing 310. Conductors in flexible conductor 330 may make electrical connections with contacts 320. Stiffening layer 340 may be placed over a top of flexible conductor 330 along a length of connector receptacle 300. Stiffening layer 340 may stabilize flexible conductor 330, thus providing a suitable substrate for contacts 320 to be soldered to.

Again, during assembly, contacts 320 may be preloaded or biased such that first portion 322 and third portion 324 are relatively lower than as shown in the assembled connector. During assembly, first portions 322 and third portions 324 are bent upward as contacts 320 are inserted into vertical slots in housing 310 from a front of housing 310, though in other embodiments of the present invention, the contacts may be inserted from the bottom or top of housing 310. Housing 310 may include lips or steps 314 to provide mechanical support for third portions 324 of contacts 320. Third portions 324 may include protrusions that essentially dig in and lock into a narrowing portion of a vertical slot near the rear of housing 310. These protrusions may help secure contacts 320 in place. A portion of housing 310 above the third portion 324 may extend horizontally through some or all of housing 310 to provide mechanical stability for the vertical slots.

The preloading of contacts 320 may help provide a consistent force between first portion 322 of contacts 320 of connector receptacle 300 and contacts 130 on tongues 122 and 124 of connector receptacle 120. However this mechanical stress may cause a bowing in connector receptacle 300. This bowing may lead to a decrease in force between contacts 320 and 130 near a center of tongues 122 and 124 of connector insert 120.

To prevent this bowing, bridges 510, 512, and 514 may be employed as shown above. These bridges may secure a top portion of housing 310 above tongues 322 and 324 to a bottom portion 312 below tongues 322 and 324.

Connectors according to embodiments of the present invention may be shielded to improve high-frequency signal performance and to reduce interference between hard-disk drive 110 and other components in an electronic device. For example, stiffening layer 340 may be metallic and grounded to provide shielding along a top of connector receptacle 300. In this example, care should be taken to avoid electrically shorting contacts 320. Shielding 702 may also be placed over stiffening layer 340. Shielding 704 may also be located along a front of connector receptacle 300 and below connector receptacle 300. For example, a shield 706 may be located under lower housing portion 312. In other embodiments of the present invention, a portion of a shield may be substituted for lower housing portion 312. Shielding may be located in any one or more of these locations consistent with embodiments of the present invention.

Again, various components of this connector may be formed of various materials. For example, connector receptacle housing 310 may be formed of plastic, nylon, liquid-crystal polymers (LCPs), or other nonconductive materials. Contacts 320 may be formed of copper, copper titanium, phosphor bronze, or other material. They may be plated or coated with nickel, gold, or other material. Flexible conductor 330 may be a flexible circuit board or other circuit board, such as one made using FR4, ribbon cable, or other type of conductor. Flexible conductor 330 may be a flexible substrate having or supporting a number of individual conductors. Stiffening layer 340 may be metal, FR4, polyimide, polyamide, or made of another material or materials.

As described above, third portions 324 of contacts 320 may include protrusions that may dig into housing 310 to provide mechanical support for contacts 320. An example is shown in the following figure.

Figure 8:
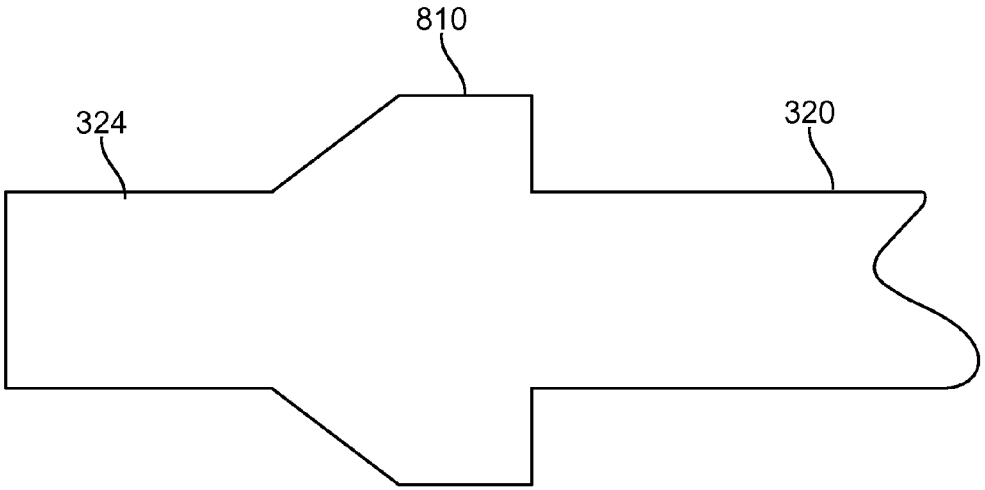
FIG. 8 illustrates a top view of a portion of a contact for a connector receptacle according to an embodiment of the present invention.

FIG. 8 illustrates a top view of a portion of a contact for a connector receptacle according to an embodiment of the present invention. Third portion 324 of contact 320 may include protrusions 810. As contact 320 is inserted into connector receptacle 300 in a leftward direction, protrusions 810 may dig into a narrowing portion of a vertical slot in housing 310. These protrusions may provide mechanical support and keep contact 360 in a secure position in housing 310.

Figure 9:
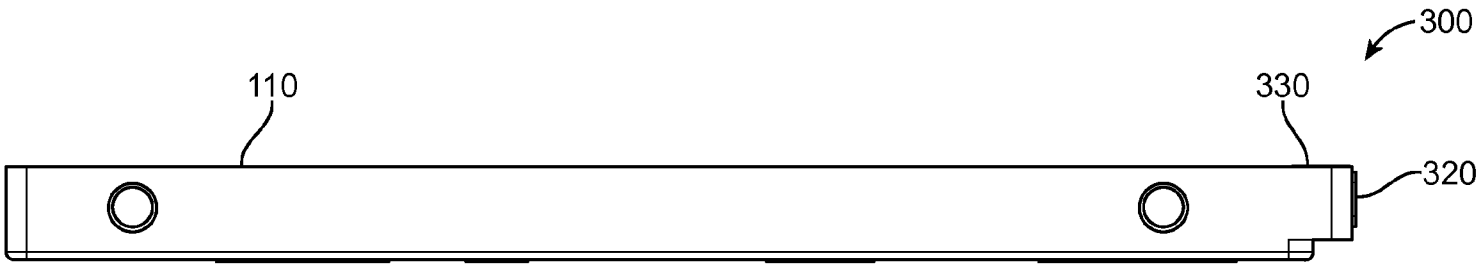
FIG. 9 illustrates side view of a hard-disk drive and a connector receptacle according to an embodiment of the present invention.

FIG. 9 illustrates side view of a hard-disk drive and a connector receptacle according to an embodiment of the present invention. Hard-disk drive 110 is contacted by connector receptacle 300 having housing 320 and flexible conductor 330. As can be seen, connector receptacle 300 consumes a limited amount of space in a device enclosure.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A method of manufacturing a connector for a hard-disk drive, the method comprising:

providing a housing having a first horizontal opening in a back side to receive a first tongue, the housing having a plurality of vertical slots, the vertical slots each having an opening in a front of the housing;

inserting contacts at the front of the housing and into the vertical slots of the housing, wherein each contact has a first portion to form an electrical connection with a corresponding tongue contact located on the tongue and a second portion to emerge from a top of the housing; and placing a flexible conductor over the top of the housing such that the second portions of each contact form an electrical connection to the flexible conductor.

2. The method of claim 1 further comprising placing a top layer over the flexible conductor.

3. The method of claim 2 wherein placing a top layer over the flexible conductor comprises placing a stiffening layer over the flexible conductor.

4. The method of claim 2 wherein placing a top layer over the flexible conductor comprises placing a metal layer over the flexible conductor.

5. The method of claim 4 further comprising connecting the metal layer to ground.

6. The method of claim 1 wherein providing a housing further comprises proving a housing having a second horizontal opening to receive a second tongue.

7. The method of claim 6 wherein placing a flexible conductor over the top of the housing comprises placing a flexible circuit board over the top of the housing.

8. The method of claim 6 wherein placing a flexible conductor over the top of the housing comprises placing a ribbon cable over the top of the housing.

9. The method of claim 1 further comprising placing a metal shield over the top of the flexible conductor and the front of the housing.

10. The method of claim 1 further comprising placing a metal shield over the over the front of the housing and under the housing.

11. The method of claim 1 further comprising placing a metal shield over the top of the flexible conductor and under the housing.

12. The method of claim 1 further comprising placing a metal shield over the top of the flexible conductor, the front of the housing, and under the housing.

13. The method of claim 1 wherein the hard-disk drive comprises a recess and the housing is arranged to substantially fit in the recess.

14. The method of claim 13 wherein the first horizontal opening extends to a front of the housing.

15. A connector for a hard-disk drive, the connector comprising:

a housing having a first horizontal opening in a back side to receive a first tongue, the housing having a plurality of vertical slots, each vertical slot having an opening in a front of the housing;

a plurality of contacts, each contact in the plurality of contacts located in a corresponding vertical slot of the housing, wherein each contact in the plurality of contacts has a first portion to form an electrical connection with a corresponding tongue contact located on the tongue and a second portion to emerge from a top of the housing; and a flexible conductor over the top of the housing such that the second portion of each contact in the plurality of contacts forms an electrical connection to the flexible conductor.

16. The connector of claim 15 further comprising a top layer over the flexible conductor.

17. The connector of claim 16 wherein the top layer comprises a stiffening layer.

18. The connector of claim 16 wherein the top layer comprises a metal layer.

19. The connector of claim 18 wherein the metal layer is connected to ground.

20. The connector of claim 15 wherein the housing further comprises a second horizontal opening to receive a second tongue.

21. The connector of claim 20 wherein the flexible conductor comprises a flexible circuit board.

22. The connector of claim 20 wherein the flexible conductor comprises a ribbon cable.

23. The connector of claim 15 further comprising a metal shield over the top of the flexible conductor and the front of the housing.

24. The connector of claim 15 further comprising a metal shield over the front of the housing and under the housing.

25. The connector of claim 15 further comprising a metal shield over the top of the flexible conductor and under the housing.

26. The connector of claim 15 further comprising a metal shield over the top of the flexible conductor, the front of the housing, and under the housing.

27. The connector of claim 15 wherein the hard-disk drive comprises a recess and the housing is arranged to substantially fit in the recess.

28. The connector of claim 27 wherein the first horizontal opening extends to a front of the housing.

* * * * *